US007186094B2

(12) United States Patent
Edlund et al.

(10) Patent No.: US 7,186,094 B2
(45) Date of Patent: Mar. 6, 2007

(54) METHOD AND APPARATUS FOR MEASURING WORK PERFORMED BY A COMPRESSOR

(75) Inventors: Carl E. Edlund, Castroville, TX (US); Ralph E. Harris, San Antonio, TX (US); Kurt A. Franke, San Antonio, TX (US)

(73) Assignee: Gas Machinery Research Council, Dallas, TX (US)

( * ) Notice: Subject to any disclaimer, the term of this patent is extended or adjusted under 35 U.S.C. 154(b) by 750 days.

(21) Appl. No.: 10/397,889

(22) Filed: Mar. 26, 2003

(65) Prior Publication Data

US 2004/0193384 A1 Sep. 30, 2004

(51) Int. Cl.
*F04B 49/00* (2006.01)

(52) U.S. Cl. ..... 417/63; 92/5 R

(58) Field of Classification Search ..... 417/63; 92/5 R

See application file for complete search history.

(56) References Cited

U.S. PATENT DOCUMENTS 4,456,963 A 6/1984 Wiggins
4,536,000 A 8/1985 Rohm
4,543,649 A * 9/1985 Head et al. ..... 367/96
4,676,095 A 6/1987 Eberle et al.
5,471,400 A 11/1995 Smalley et al.
5,564,274 A 10/1996 Denbraber
5,630,709 A * 5/1997 Bar-Cohen ..... 417/322
5,850,044 A 12/1998 Spletzer
5,887,430 A 3/1999 Hirai
6,119,579 A * 9/2000 Pawelski ..... 92/5 R
6,292,757 B1 9/2001 Flanagan et al.
6,341,553 B1 1/2002 Rohm
6,484,620 B2 * 11/2002 Arshad et al. ..... 92/5 R
2001/0037689 A1 * 11/2001 Krouth et al. ..... 73/861.52
2004/0105484 A1 * 6/2004 Ha ..... 374/141

* cited by examiner

*Primary Examiner*—William H. Rodriguez
(74) *Attorney, Agent, or Firm*—Crutsinger & Booth

(57) ABSTRACT

An apparatus and method for monitoring a reciprocating member of a reciprocating piston compressor is presented. The apparatus and method provide a means for measuring parameters of the reciprocating member, such as road load or cross-head temperature and the like, and wirelessly transmitting the data to a receiver. A mobile assembly is attached to a reciprocating member of the compressor, the mobile assembly having a sensor assembly, a wireless transmitter and a power generation assembly. The sensor assembly measures a parameter of the reciprocating member and generates a representative sensor signal. The wireless transmitter wirelessly transmits a corresponding data signal to a stationary assembly mounted nearby. The power assembly powers the transmitter and sensor assembly. The measured data is used, in conjunction with other measurements, such as a crankshaft encoder, to calculate the work performed by the compressor, the power used by the compressor and other information. The compressor utilization is then optimized based on the gathered information.

27 Claims, 5 Drawing Sheets

METHOD AND APPARATUS FOR MEASURING WORK PERFORMED BY A COMPRESSOR

FIELD OF INVENTION

The present invention relates in general to engine analysis and more particularly to apparatus and methods for measuring work performed by reciprocating piston machines, such as those used in compressors.

BACKGROUND OF THE INVENTION

In the gas transmission industry, it is necessary to operate large reciprocating type compressors at regular intervals along the pipeline. Both engine driven, and electric motor driven reciprocating compressors are used. Traditionally, the engine driven compressors (operating in the 300-rpm range) incorporate a common frame and crankshaft and are called integral reciprocating compressors. More recently, modem high-speed compressors (500–1000 rpm) using higher efficiency drives are installed which use separate frame and crankshaft and are called separable type units. These separable type units can be driven by engines, or electric motors, with the electric motors either fixed or variable speed.

Pipeline compressors often operate unattended for protracted periods in remote locations and require a host of instrumentation to ensure failsafe operation. Periodically, the efficiency of the compressors are measured to determine the health of the unit, as well as ensure optimum performance of the unit. With the increasing desire to improve both the reliability of the industry installed infrastructure, and to reduce engine emissions, real time monitoring of key operating parameters of the compressor is needed. These parameters include compressor power consumption, as well as internal temperature of key reciprocating components.

To measure efficiency of the compressor it is necessary to determine the work performed by the compressor unit. Prior art techniques have involved the calculation of indicated horsepower through the measurement of pressure in the cylinder head or at the discharge and suction sides of the compressor. Problems exist with such methods, however. Pressure sensors can be expensive, inherently produce signal errors, and have limited durability, resulting in lost time and efficiency during replacement of failed pressure sensors. Accurate measurement of compressor cylinder pressure is hampered by the acoustic distortion introduced by the measurement channel between the cylinder and the installed pressure sensor. This distortion is particularly severe on the modem high-speed compressors. Moreover, measurement of cylinder pressure and the resulting calculated work does not include the frictional costs of the piston riding on the cylinder walls. For large compressors in the range of 2000 HP to 10,000 HP or above, these losses can be significant. Accordingly, there is a need for an apparatus for accurately and continuous measurement of the actual work performed by a compressor.

SUMMARY OF THE INVENTION

An apparatus and method for monitoring key parameters of a reciprocating member of a reciprocating piston compressor is presented. The apparatus and method provide a means for measuring parameters of the reciprocating member, such as load or cross-head temperature and the like, and wirelessly transmitting the data to a receiver. A mobile assembly is attached to a reciprocating member of the compressor, the mobile assembly having a sensor assembly, a wireless transmitter and a power generation assembly. The sensor assembly measures a parameter of the reciprocating member and generates a representative sensor signal. The wireless transmitter wirelessly transmits a corresponding data signal to a stationary assembly mounted nearby. The power assembly powers the transmitter and sensor assembly.

The measured data is used, in conjunction with other measurements, to calculate the work performed by the compressor, the power used by the compressor and other information. The compressor utilization, health and integrity is then used by the compressor controllers (either human or software based) to optimize operation.

DETAILED DESCRIPTION OF THE INVENTION

Directly measured parameters of the reciprocating components of a compressor are not readily available because of the difficulties in directly accessing and transmitting the key sensor data. The rapid movement and resulting forces on a monitoring sensor and associated devices, wires, circuitry and the like, make direct monitoring difficult. For example, directly measured brake horsepower is not readily available on compressors, such as those used in the gas pipeline industry. Typically compressors are controlled based on indirect measurements, such as torque inferred from fuel flow, suction pressure, discharge pressure, swept volume and clearance. This leads to inaccuracies in the measurement of the load on the engine, limits the ability to take full advantage of the flexibility available and can result in overloading the compressor and parts, such as the frame, crankshaft, rods and bearings. A cost-effective apparatus and method is presented for directly measuring parameters of a reciprocating motor or compressor port. More specifically, an apparatus for directly measuring rod strain on a compressor is provided. The data acquired may then be used to calculate power and work performed by the compressor. Similarly, other parameters of the reciprocating members, such as the temperature of the cross-head bushing may be measured. The resulting information can be used to control and limit potential operating conditions leading to part overloading, reducing the likelihood of potentially catastrophic failures.

Using the presented apparatus and method makes it possible to operate the compressor at maximized efficiency, and in combination with other measurements, such as compressor temperature or enthalpy rise, fuel flow, crank shaft angle and other parameters, to locate capacity and performance problems more accurately.

Figure 1:
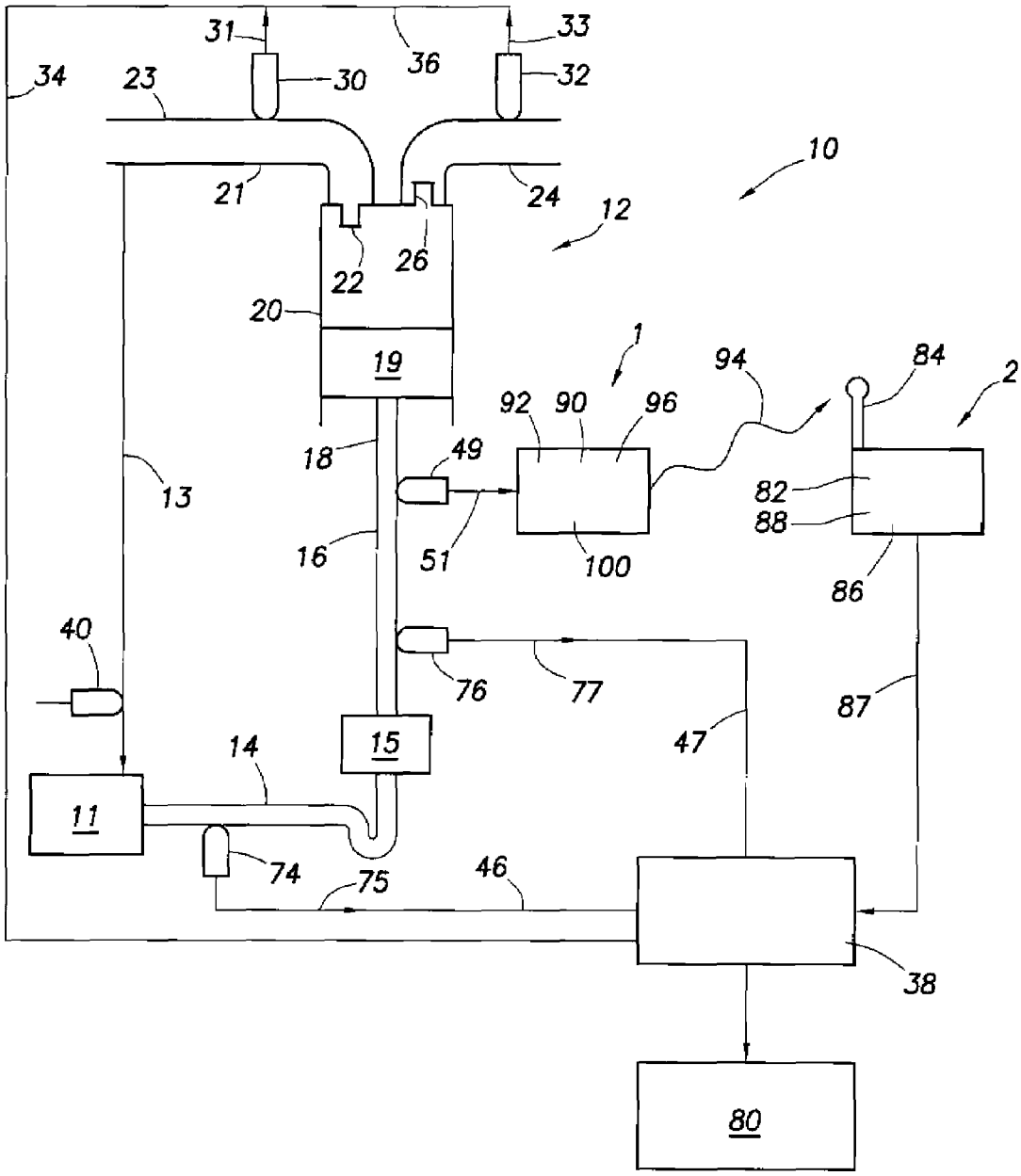
FIG. 1 is a schematic diagram showing an apparatus of the invention in use on a compressor.

FIG. 1 shows schematically an apparatus of the invention, generally designated 10, being used for analyzing certain parameters of a reciprocating piston compressor, generally designated 12. The monitoring device 10 comprises a mobile assembly 1 mounted directly to the reciprocating member and a stationary assembly 2 placed to wirelessly receive data signals from the mobile assembly 1. A motor 11 is illustrated as being supplied with fuel from a line 13 connected to the same source as the gas to be compressed by the compressor 12, although fuel could alternately be provided by other means.

The construction of the compressor 12 is conventional and will therefore only be described very briefly. The compressor 12 comprises a crankshaft 14 rotated by the prime driver (engine or electric motor) of the compressor. This crankshaft 14 is connected to a slider 15 which is in turn connected to a connecting rod 16, which is in turn connected to a piston rod 18. The piston rod 18 drives the piston 19 itself. The rotation of the crankshaft 14 causes the piston 19 to reciprocate within a cylinder 20. A typical compressor will employ a slider and connecting rod assembly, but this arrangement may be modified as is known in the art.

The cylinder is provided with an inlet line 21, connected to a source of gas such as gas pipeline 23, flow of gas from the inlet line 21 into the cylinder 20 being controlled by an inlet valve 22. The cylinder 20 is also provided with an outlet line 24, egress of gas from the cylinder 20 into the outlet line 24 being controlled by an outlet valve 26. As is conventional in the art, operation of the disk type valves 22 and 26 is typically controlled by pressure differentials so that gas is drawn from the inlet line 21 through the inlet valve 22 into the cylinder 20, there compressed by the piston 19 and the compressed gas allowed to flow out of the cylinder via the valve 26 into the outlet line 24.

The apparatus 10 of the invention is used in conjunction with the compressor 12 and has a mobile assembly 1 and a stationary assembly 2. The mobile assembly 1 comprises a sensor assembly 49, such as a rod load monitor 50 or temperature sensor 53, an encoder 92, a processor 90, a wireless transmitter 96 and a power source 100.

The mobile assembly is designed to measure one or more parameters of the reciprocating parts of the compressor, such as the crankshaft cross-head or bushing, the connecting rods, slider or piston rods. The mobile assembly is mounted to the reciprocating member. Various parts of the mobile assembly may be mounted to various reciprocating members, that is, the sensor assembly 49 can be mounted to a connecting rod while the transmitter is mounted to the slider. Throughout, where reference is made to mounting a portion of the mobile assembly to a reciprocating member of the compressor it is understood that various mobile assembly parts may be mounted to various reciprocating parts. Various parameters may be measured, such as rod strain or load, axial and transverse loading, temperature, enthalpy, or other parameters considered relevant to monitoring the performance and efficiency of the compressor.

In one embodiment, the sensor assembly 49 comprises a rod strain monitor 50, preferably mounted to the rod 18, for measuring the load or strain on the rod when the compressor is in use. Alternately, the rod strain monitor 50 may be mounted to other moveable compressor parts, preferably linearly reciprocating members, such as crankshaft 14, especially at cross-head bushing 54, piston rod 18 or even cross-head 15. The sensor assembly 49 generates a representative sensor signal 51. In this case, the rod strain monitor 50 generates a rod strain signal 51 representative of the strain on the piston rod 18.

Figure 2:
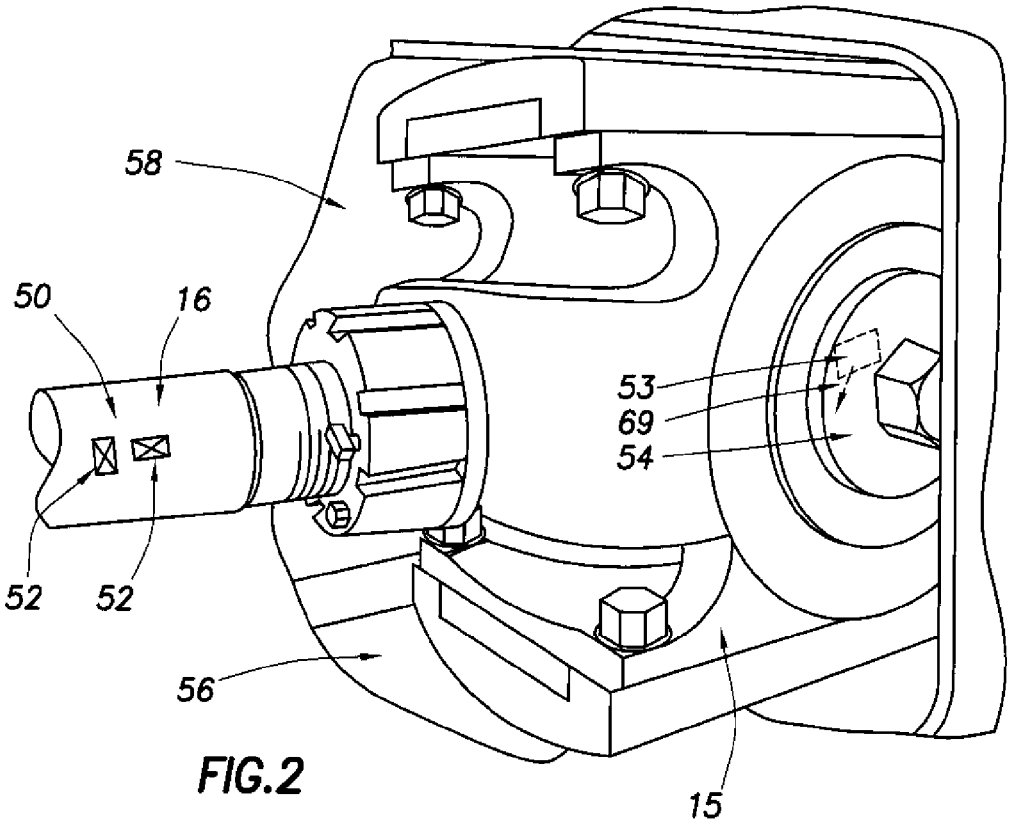
FIG. 2 is an elevation view of a portion of a compressor.
Figure 3:
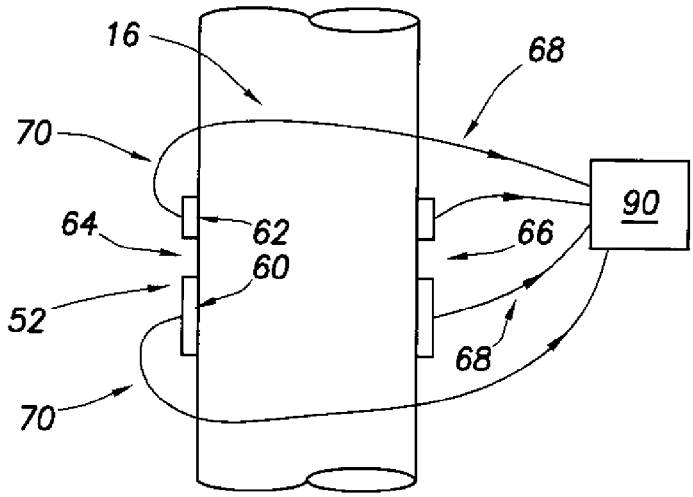
FIG. 3 is a schematic showing placement of a load cell on a compressor rod.

The rod strain sensor 49 comprises multiple strain gauges 52 mounted about the surface of the piston rod 18, as seen in FIGS. 2 and 3. FIG. 2 presents the cross-head 15, connected to the crankshaft 14 at cross-head bushing or connector 54. The cross-head 15 moves linearly along channel 56. Back cover 58 is shown and typically a similar front cover encloses the cross-head 15 and piston rod 18.

The strain gauges 52 are mounted on piston rod 18 to sense axial and lateral, or bending, loads on the rod 18. Preferably two pairs of strain gauges 52 are employed, as best seen in FIG. 3. Each pair consists of two strain gauges 52, one mounted axially 60 to measure axial strain under axial loading and one mounted laterally 62 to measure circumferential (poisson) bending strain in the rod. The axially mounted strain gauges will respond to axial loading but will also be effected by bending loading. The laterally mounted strain gauges 62 will isolate strain due to bending forces allowing accurate calculation of strain due solely to axial loading. The first pair 64 and second pair 66 are mounted opposite one another on the rod. In this way the strain in the rod due to bending forces can be identified and, if desired, eliminated from measurement, thereby isolating the axial load on the rod.

Each of the strain gauges generates a representative strain gauge signal 68. The strain gauge signals 68, are transmitted to mobile assembly processor 90. Preferably, the strain gauges 52 are wired to the mobile assembly processor 90 via wire lines 70, seen in FIG. 3.

Other sensor assemblies may be used with the present apparatus to monitor other parameters of reciprocating portions of the compressor. For example, a temperature sensor 53 may be mounted to a reciprocating part of the compressor, such as to cross-head bushing 54. Temperature sensors are known in the art. The temperature sensor measures the temperature of the compressor part allowing monitoring of the compressor. For example, an unexpected temperature rise may herald a potential catastrophic failure of the compressor. Monitoring such a rise in temperature would allow the user to shut down the compressor for repair prior to such a failure. The temperature sensor 53 is connected to the mobile assembly power source 100, for powering the sensor, and produces a temperature sensor signal 69 which is transmitted to the processor 90 and encoder 92, as necessary, so that the signal may be wirelessly transmitted via transmitter 96.

The representative sensor signal 49, such as strain gauge signal 51 or temperature signal 69, is processed by the mobile assembly data processor 90. The processor 90 may include amplifiers, filters, data storage units, a CPU, gauge bridges, A/D and other converters, clocks, calculators, software and other devices as known in the art.

For example, the processor 90 may include an encoder 92 to convert analog signals to digital signals as necessary. Preferably the processor 9o0 will include a low noise amplifier to amplify to a more usable level the output of the strain gauge signals. Similarly, the processor may employ an electronic integrator as a negative feedback element in the amplifier to eliminate or reduce any static levels in the representative signals. The representative signals typically are output from the sensors as a voltage. The mobile assembly processor 90 operates to generate a wireless signal 94, such as a radio frequency signal, for transmission to the stationary assembly 2. The mobile assembly processor 90 may include an electronic device, such as a VCO, which outputs a continuous train of fixed width pulses whose frequency is proportional to the rod strain, as measured in voltage by the rod load monitor 50. Further circuitry may be used, such as for generating a static offset voltage to the VCO so as to establish a stable signal.

The mobile assembly is preferably a smart tool capable of performing calculations, algorithms and running programs and/or software. The mobile assembly processor 90, for example, may perform sums and otherwise manipulate the representative sensor signals 51. For example, the processor 90 may isolate the axial strain on the rod prior to transmission of the wireless signal 94. Alternately, the transmitter 96 may send a wireless signal 94 without such manipulation of the measured data prior to transmission. Preferably the encoder and transmitter 96 will produce continuous real-time data flow for transmission to the data receiver 82 and data processor 88. Alternately, the information can be stored and sent on a time-delay basis or in occasional data pulses. A CPU may be employed in the processor 90 to conduct analysis or manipulation of the received representative signals, however, it is preferred that these functions occur at the stationary assembly data processor 86.

The mobile assembly 1 also includes a wireless transmitter 96. The mobile assembly processor 90 is connected to the transmitter 96. The wireless transmitter 96 wirelessly transmits wireless signal 94 to the receiver 82 of stationary assembly 2. The wireless signal 94 may be an optical, or RF based. Preferably, the signal 94 is an RF signal. Thus the transmitter 96 and receiver 82 of the stationary assembly 2 eliminate the need for direct by-wire transmission of data garnered from the reciprocating parts of the compressor 12. Preferably the transmitter is a low power transmitter capable of transmitting a signal over at least a few feet. The stationary assembly antenna is then mounted for receiving the transmitted data near the compressor reciprocating parts. The antenna is preferably mounted to the compressor itself.

As shown in FIG. 1, power for the operation of the various components of the mobile assembly 1 is provided with a power source 100. In a preferred embodiment of the invention, the power necessary to operate various electrical components of the mobile assembly is supplied through the operation of the compressor itself.

An inductive coil power generator is presented. A magnetic array 102 is mounted on a stationary portion of the compressor in alignment with an inductive coil 104, mounted on a reciprocating part of the compressor, the coil being mobile with respect to the array. For example, the magnetic array can be mounted to back plate 58, as seen in FIG. 2. The inductive coil 104 would then be mounted on a reciprocating member, such as slider 15 such that motion of the slider 15 would result in motion of the inductive coil 104 adjacent the magnetic array. The motion of the coil in relation to the magnet induces an electrical current in the coil used to power the various electrical components of the mobile assembly. The power source 100 also includes any necessary circuitry, such as circuitry 106 for rectifying the induced coil voltage, smoothing the voltage and regulating it to a fixed value.

Figure 5:
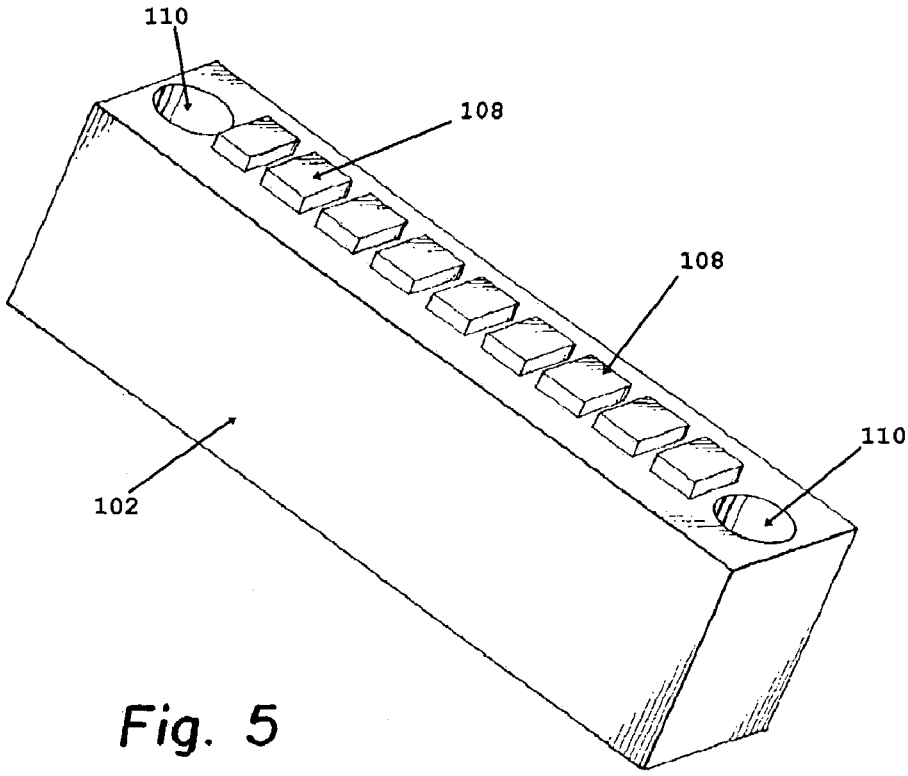
FIG. 5 is a view of a linear magnetic array.
Figure 6:
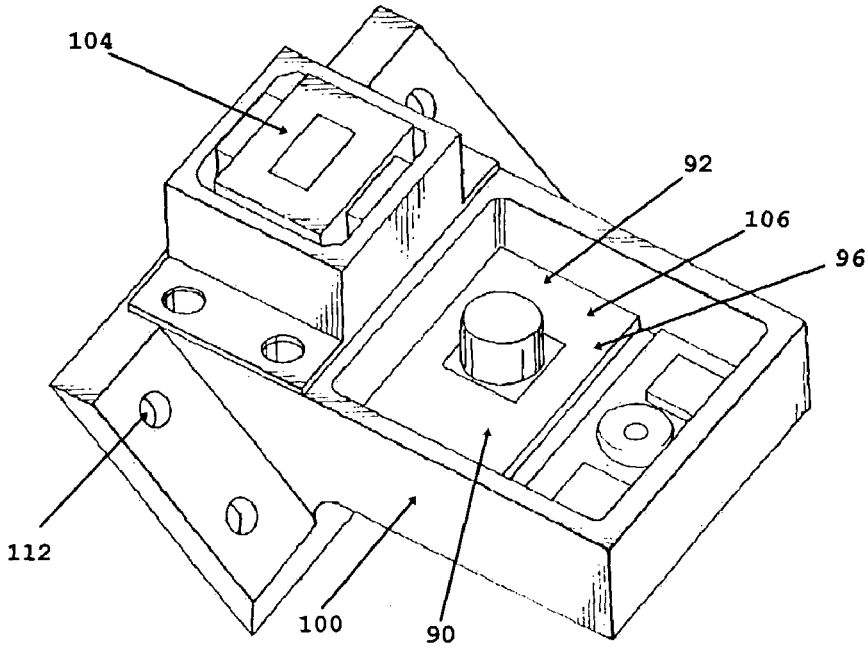
FIG. 6 is a view of an electrical unit including an inductive coil the electronics package.
Figure 7:
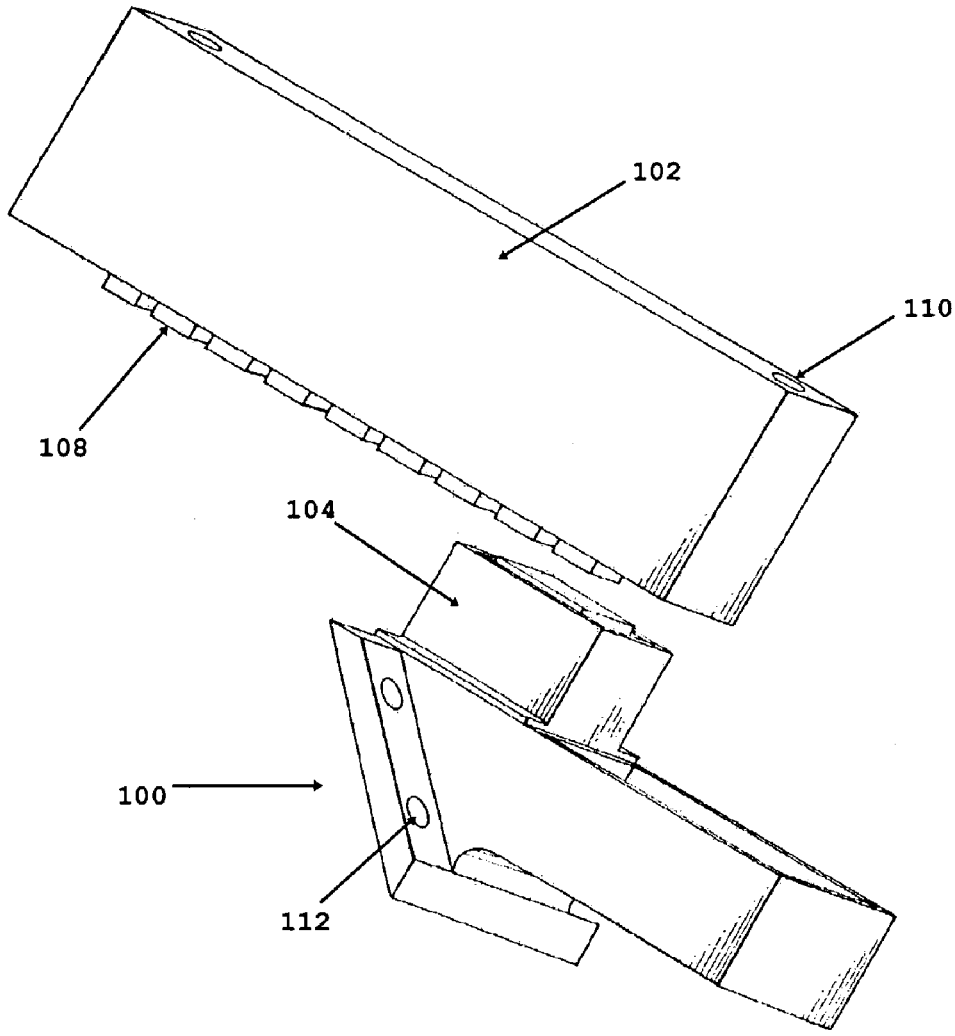
FIG. 7 is a view of the magnetic array and electrical unit in relational alignment.

The linear magnetic array 102 is shown in FIG. 5 and has a plurality of magnets 108 in a linear arrangement. Mounting holes 110 are provided for mounting to the compressor 12, preferably to the plate 58. An electrical unit 100 is illustrated in FIG. 6. The unit 100 includes an induction coil 104. The unit 100 is preferably mounted to the cross-head 15, or other mobile compressor part, to move adjacent the magnetic array 102. FIG. 7 shows the aligned relationship between the magnetic array and the inductive coil. The unit 100 also houses any necessary circuitry 106 to regulate or manipulate the power supply. The unit 100 is designed to be mounted to the apparatus via mounting holes 112. The exact configuration of the magnetic array and coil are not critical and those skilled in the art will recognize alternative mountings and configurations.

The electrical unit 100, the mobile assembly processor 90, encoder 92 and transmitter 96 may all be physically located in a single housing, as seen in FIG. 6.

The self-contained power source 100 of the mobile assembly 1 eliminates the need for a wired power supply to the mobile device. The power source 100 could be a battery or other source capable of being mounted to the reciprocating parts for the compressor, however, a power generator such as an inductive coil assembly is preferred since it would eliminate the need for frequent replacement.

The stationary assembly 2 includes a receiver 82, an antenna 84, a power source 88 and a processor 86. The antenna 84 of the receiver 82 receives the wireless signal 94 from the mobile assembly 1. The wireless signal 94 is then manipulated as necessary by the stationary assembly processor 86 which can include decoders, clocks, pulse generators, stabilizers, a CPU, software, programs and other devices. The stationary assembly 2 circuitry is powered by power source 88, such as a battery, by direct wiring to an electrical supply or other source, such as a solar power generator.

The processor 86 includes various circuitry. For example, it has been found that the following arrangement works well where the transmitted signal 94 is an RF signal which is to be converted into a voltage signal for further manipulation. A cascade of two Schmidt input triggers produces essentially a duplicate of the VCO output containing the strain signal data. The signal is used to trigger a one shot pulse generator whose output is a fixed time width and fixed amplitude pulse train whose frequency is proportional to rod strain. The frequency of the pulse train preferably ranges from 50 to 100 KHz, but can have a wider range. The pulse train is input to a four pole Butterworth active filter configured for a gain of four and a cutoff frequency of one KHz. The output of this filter is then a band limited analog voltage replica of the rod strain. Circuitry to remove any offset generated in the mobile assembly processor 90 to provide a stable voltage to the filter may be included. Circuitry for producing stable low noise plus and minus 3.0 volt power for all of the stationary device 2 circuitry from a 9.0 volt batter or other suitable power source 88.

The wireless transmitter 96 and stationary assembly 2 including a receiver eliminates the need for a wire connection with the stationary assembly 2 for transmission of the measurements collected by the mobile assembly 1.

The apparatus may include various other sensors, as are known in the art, some of which are necessary to use in conjunction with the rod load monitor to determine the work of the compressor rod. In a preferred embodiment, a crank angle indicator will be employed. Alternately, a rod location sensor of some kind may be used. Further sensors may be employed in conjunction with the rod load monitor, as are known in the art, whether to determine work, correct or double-check other measurements or supply information for other purposes. For example, a crank angle encoder 74, a rod member location sensor 76 and/or pressure sensors 30 and 32 may be used. Similarly, other sensors may be used in conjunction with the temperature sensor 53 to monitor the conditions of the compressor.

The apparatus preferably includes a crank angle encoder 74. Crank angle encoders are well known in the art and will not be explained in detail here. The crank angle encoder is attached to the crankshaft 14 via some sort of shaft arrangement so that the crank angle encoder 74 is rotating at the same speed as the compressor 12. There are a number of acceptable methods to attach the crank angle encoder 74, but it must be attached in a manner such that there is not any slippage thereby insuring that the encoder 74 rotates at the same one-to-one relationship as the crankshaft. The crank angle encoder 74 preferably produces two signals on its output, one of which is a one pulse per revolution signal. In other words, a digital logic level change occurs each time the shaft of the encoder assembly makes one revolution and it occurs at the same mechanical point each time. Alternately, a separate device may be used to determine the operating speed of the compressor. The other output channel of the encoder 74 provides a digital pulse or logic pulse at each degree of shaft rotation of the encoder 74. The encoder 74 is synchronized to top dead center, or some other known point, of the reference cylinder in the compressor 12. The encoder 74 therefore provides a measure of the location, measured in degrees, of the crankshaft 14 which corresponds to the linear location of the connecting rod 16 or piston rod 18 upon which the rod load monitor 50 is mounted. The crank angle encoder 74 produces a crank angle signal 75 representative of the data collected by the encoder 74. That signal 75 is transmitted along line 46 to the unit controller 38.

The apparatus may also include a rod location sensor 76 as is known in the art. The rod location sensor 76 serves a similar function to the crank angle indicator and will not be described in detail. The sensor 76 provides a generated rod location signal 77 representative of the location of the rod in its travel along its function path such that the user has an indication of the location of the rod. The representative rod location signal 77 is transmitted to the unit controller 38.

The apparatus 10 of the invention used in conjunction with the compressor 12 may also include pressure sensors, such as a suction pressure sensor 30 fixed in the inlet line 21 so as to measure the suction pressure of gas entering the compressor. Appropriate pressure sensors for this purpose are well known to those skilled in the art and are readily available commercially. Such a sensor 30 generates a suction pressure signal 31 representative of the suction pressure of the gas entering the compressor. The apparatus 10 of the invention may further comprise a discharge pressure sensor 32 fixed in the outlet line 24 so as to measure the pressure in this line, which is the discharge pressure of gas leaving the compressor. The pressure sensor 32 generates a discharge pressure signal 33 representative of the discharge pressure. Optionally, the pressure sensors 30 and 32 may be attached to the cylinder of the compressor 12. A common method of attaching the pressure sensors is through some type of indicator valve. Compressors often provide indicator valves as part of the standard equipment of the compressor. The compressor indicator valves have adapters by which to attach the pressure sensors. The industry is well aware of the indicator valves and many compressors are equipped with such. Use of pressure sensors in determining compressor work is known in the art and addressed in U.S. Pat. No. 4,676,095 to Eberle, U.S. Pat. No. 6,292,757 to Flanagan and U.S. Pat. No. 4,456,963 to Wiggins, which are incorporated herein by reference for all purposes.

The invention is designed to reduce dependence on pressure sensors for determining the work performed by a compressor. However, the invention may be used in conjunction with such sensors. The pressure and strain data may be used in conjunction or as comparative data. The function of the remaining sensors, such as the crank angle indicator, is to provide the remaining data necessary to determine the work performed by the compressor. The number and types of sensors or information is used is not critical to the invention, but a crank angle indicator is preferred.

Other sensors, such as a fuel consumption flow rate or other, sensor 32 may be used as well.

The representative signals 31, 33, 75 and/or 77 from the pressure sensors 30 and 32, crank angle encoder 74 and/or rod member location indicator 76, respectively, are sent via lines 34, 36, 52, 46 and 47 respectively to sensor unit controller 38. The unit controller 38 is designed to receive the representative signals from the various indicators. The controller 38 may include amplifiers, band pass filters, data storage units, a CPU, gauge bridges, A/D converters and other devices as are known in the art. For example, the processor may convert analog signals to digital signals as necessary. The controller may include a calculator, timing and other circuitry, converter software, storage capacity and cumulative mathematical calculations.

The controller 38 may include many members and be located on or off-site or partially off-site. That is, the controller 38 is not limited to a single physical location. The controller 38 may compute or monitor certain parameters on-site while transmitting these or other parameters to an off-site control room. On-site monitoring and control may, for example, include emergency shut-down control in the case of an actual or impending failure. The controller will be used to control the compressor operation. Typically at least some of the controller function is remote to the compressor site.

The unit controller 38 acts as the central processing unit carrying out the logic functions of the apparatus 10. The controller 38 may comprise a single computer or a multiplicity of computers or other calculator devices. The controller 38 may be located on site or remote from the compressor. It is anticipated that the controller will most likely be remote from the compressor and will receive data from a plurality of compressors spread over a wide geographic area. The controller may contain a microprocessor, digital input and output subsystems, memory capacity in which is stored various mathematical and analytical programs and software and constant data regarding the compressor being analyzed. One of the primary functions of the controller is to compute, using the representative data signals, the work performed by the compressor during a predetermined time interval. The controller may include the necessary formulas for repetitive calculations of performance parameters. Preferably the controller, in conjunction with the rod load monitor, other sensors and transmitter/receiver pair, permits continuous real-time monitoring of the compressor. Real-time and continuous work calculations can then be performed and monitored.

The actual calculations used to determine the instantaneous power used by the compressor or the work performed by the compressor based on the strain in the compressor rod are similar to those known in the art using the PV card method based on the measured pressures at the intake and discharge ports of the compressor cylinder. The brake horsepower is similarly calculated. The PV card method is described, for example in U.S. Pat. No. 4,676,095 to Eberle, incorporated herein.

Figure 4:
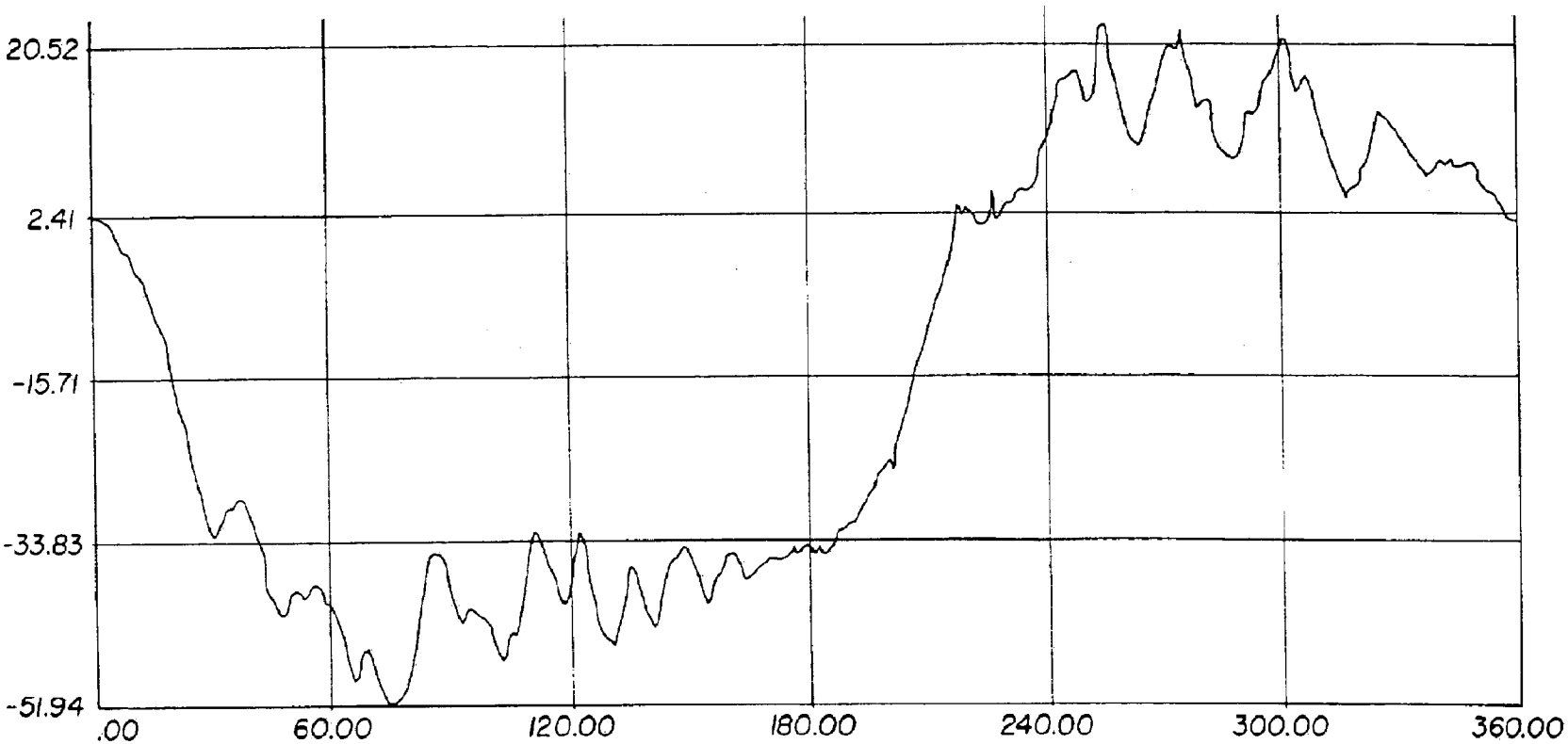
FIG. 4 is a graphical representation of strain versus degrees of travel of the compressor rod.

The current invention uses a similar system amounting to a strain-distance card. The measurement of strain on the compressor rod by the rod load monitor 50 and measurements from the crank angle indicator 74 are used to create a strain versus distance graph, such as in FIG. 4. FIG. 4 illustrates an exemplary graph, in this case showing the compressive and axial strain on the compressor rod as measured by the strain gauge. Strain is a dimensionless unit.

Alternately a force-distance card could be used, where force is the product of strain, the cross-sectional area of the connecting rod and Young's modulus of elasticity. The strain or force is graphed versus distance, since work equals force times distance, in this case using degrees to indicate the location of the rod along its stroke path. Other values needed to determine power and work are known constants or separately measured, such as the cross-sectional area of the compressor rod, the modulus of elasticity, the distance traveled by the compressor rod, time expended, etc. The work may be summed over time to indicate a running total of work done. The integral of work over time is then displayed for use as is appropriate.

Other calculations may be made as well, such as the computation of work and power based on pressure measurements. The measurements and results of the calculation can then be used for optimization 80 of the efficiency and use of the compressor. That is, the resulting data from the data processor may be used to regulate the operation of the compressor to maximize the efficiency of the unit. Where several compressor units are being monitored simultaneously, the compressors can each be regulated to maximize the efficiency of the pipeline operation as a whole. The compressor utilization, health and integrity is then used by the compressor controllers (either human or software based) to affect operation in an optimized fashion. The optimization and regulation of the compressor units can be done manually, by remote transmission or direct manipulation, or automatically through the use of computer optimization software.

Optimization can also include automatic shut-downs where the measured parameters indicate a failure or danger of catastrophic failure. For example, the temperature sensor 53 may be a indicator of impending failure. A sharp temperature rise may indicate a need to turn off the compressor. Similarly, the rod load monitor may be used to monitor the actual load on the connector rod and compare the actual load with the specifications of the rod. An overload of the rod can be monitored and the compressor controlled or shut down to prevent a rod failure.

It will be apparent to those skilled in the art that further variations in the apparatus and process of the invention can be made. The apparatus can be used to monitor parameters on any reciprocating motor member. The apparatus may be modified for use in multi-stage compressors by providing separate rod load monitors for measuring the strain during each stage. In view of the various possible changes and modifications in the preferred embodiment of the invention described above, the whole of the foregoing description is to be construed in an illustrative and not in a limitative sense, the scope of the invention being defined solely by the appended claims.

The invention having been described, it is claimed:

1. A method of monitoring a reciprocating piston compressor, the compressor having a reciprocating member, the method comprising the steps of:

sensing a parameter on the reciprocating member;

generating a representative sensor signal in response to the sensed parameter;

wirelessly transmitting from the reciprocating member a data signal related to the representative sensor signal; and wirelessly receiving the data signal at a location spaced from the reciprocating member.

2. A method as in claim 1, wherein the step of sensing a parameter further comprises the step of monitoring the load on the reciprocating member.

3. A method as in claim 1, wherein the step of sensing a parameter further comprises the step of sensing the temperature of the reciprocating member.

4. A method as in claim 1, wherein the step of transmitting further comprises the step of manipulating the representative sensor signal.

5. A method as in claim 4, wherein the step of generating comprises generating a voltage signal and wherein the step of transmitting comprises manipulating the voltage signal to a frequency signal.

6. A method as in claim 1, wherein the step of sensing comprises mounting a plurality of strain gauges on the compressor reciprocating member.

7. A method as in claim 1 further comprising the step of calculating the load on the reciprocating member.

8. A method as in claim 1 further comprising the step of calculating the load on the reciprocating member.

9. A method as in claim 1 further comprising the step of calculating the power used by the compressor.

10. A method as in claim 1 further comprising the step of optimizing the operation of the compressor.

11. A method as in claim 1 wherein the step of receiving the data signal further comprises manipulating the data signal.

12. A method as in claim 1, the transmitting done with a transmitter, the sensing done with at least one sensor, and further comprising the step of generating power on the reciprocating member to power the transmitter and at least one sensor.

13. A method as in claim 12, the power generating performed by an inductive coil generator.

14. A method as in claim 1, the compressor having a pressure inlet and a pressure outlet and further comprising the step of sensing the pressure at the pressure inlet and outlet.

15. A method as in claim 1, the compressor having a crankshaft and further comprising the step of sensing the position and speed of the crankshaft, producing a representative crankshaft signal and using the representative crankshaft signal in conjunction with the representative sensor signal to calculate data about the compressor.

16. A method of monitoring a machine, the machine having a reciprocating member, the method comprising the steps of:

sensing at least one parameter on the reciprocating member;

generating a representative sensor signal in response to the at least one sensed parameter;

wirelessly transmitting from the reciprocating member a data signal related to the representative senor signal; and wirelessly receiving the data signal at a location spaced from the reciprocating member.

17. A method as in claim 16, wherein the step of sensing a parameter further comprises the step of monitoring the load on the reciprocating member.

18. A method as in claim 16, wherein the step of sensing a parameter further comprises the step of sensing the temperature of the reciprocating member.

19. A method as in claim 16, wherein the step of transmitting further comprises the step of manipulating the representative sensor signal.

20. A method as in claim 19, wherein the step of generating comprises generating a voltage signal, and wherein the step of transmitting comprises manipulating the voltage signal to a frequency signal.

21. A method as in claim 16, wherein the step of sensing comprises mounting at least one gauge on the compressor reciprocating member.

22. A method as in claim 16 further comprising the step of calculating the load on the reciprocating member.

23. A method as in claim 16 further comprising the step of calculating the load on the machine.

24. A method as in claim 16 further comprising the step of calculating the power used by the compressor.

25. A method as in claim 16 further comprising the step of optimizing the operation of the compressor.

26. A method as in claim 16, the transmitting done with a transmitter, the sensing done with at least one sensor, and further comprising the step of generating power on the reciprocating member to power the transmitter and at least one sensor.

27. A method as in claim 26, the power generating performed by an inductive coil generator and magnetic array.

* * * * *